US007198573B2

(12) United States Patent
Kim

(10) Patent No.: US 7,198,573 B2
(45) Date of Patent: Apr. 3, 2007

(54) GOLF BALL CONVEYING APPARATUS

(76) Inventor: Si-Myung Kim, A-301 Hyundai Hitz Villa, No. 106-34, Junggok-dong, Kwangjin-gu, Seoul (KR)

( * ) Notice: Subject to any disclaimer, the term of this patent is extended or adjusted under 35 U.S.C. 154(b) by 0 days.

(21) Appl. No.: 11/111,693

(22) Filed: Apr. 22, 2005

(65) Prior Publication Data

US 2005/0282648 A1 Dec. 22, 2005

(30) Foreign Application Priority Data

Jun. 16, 2004 (KR) ..... 10-2004-0044392

(51) Int. Cl.
*A63B 69/36* (2006.01)

(52) U.S. Cl. ..... 473/132

(58) Field of Classification Search ..... 473/132–137; 198/642, 657, 676, 677; 124/78, 79
See application file for complete search history.

(56) References Cited

U.S. PATENT DOCUMENTS

| | | | | |
|---|---|---|---|---|
| 3,448,985 | A * | 6/1969 | Scott | 473/136 |
| 3,567,223 | A * | 3/1971 | Gentiluomo | 473/135 |
| 4,025,071 | A * | 5/1977 | Hodges | 473/436 |
| 4,352,348 | A * | 10/1982 | Griffith | 124/78 |
| 4,875,459 | A * | 10/1989 | Van Elderen et al. | 124/78 |
| 5,143,202 | A * | 9/1992 | Lehmann et al. | 198/670 |
| 6,155,403 | A * | 12/2000 | Thrasher | 198/642 |
| 6,287,212 | B1 * | 9/2001 | Wetherell et al. | 473/163 |

* cited by examiner

*Primary Examiner*—Steven Wong
(74) *Attorney, Agent, or Firm*—Egbert Law Offices

(57) ABSTRACT

The golf ball conveying apparatus is provided in a place such as an indoor driving range to collect a golf ball, struck by a golfer, and places the golf ball onto a golf tee again. The golf ball conveying apparatus prevents dimples of a golf ball from wearing during a process of conveying the golf ball and solves a problem in which a ball conveying pipe becomes clogged by a damaged golf ball supplied into the ball conveying pipe.

2 Claims, 5 Drawing Sheets

GOLF BALL CONVEYING APPARATUS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to golf ball conveying apparatuses which are provided in places such as indoor driving ranges to collect a golf ball, struck by a golfer, and place the golf ball onto a golf tee again and, more particularly, to a golf ball conveying apparatus which prevents dimples of a golf ball from wearing during a process of conveying the golf ball and solves a problem in that a ball conveying pipe becomes clogged when a damaged golf ball enters the ball conveying pipe.

BACKGROUND OF THE INVENTION

Generally, as shown in FIG. 1, in an indoor driving range, golf balls, struck by golfers, are collected and supplied to a golf ball conveyor 1 provided on an upper portion of the indoor driving range. Thereafter, the golf balls are supplied to a plurality of tee areas through first ball conveying pipes 2. Golf balls, which have been supplied to each swing section, enter a temporary storage container 3 which has an air blower 3*a* and a golf ball storage box 3*b*. When no golf ball is in a tee-up device 4 embedded in the ground after a golfer has struck the previous golf ball, the air blower 3*a* of the temporary storage container 3 operates. Thus, a golf ball, which has been in the golf ball storage box 3*b*, is rapidly supplied to the tee-up device 4 through a second ball conveying pipe 6 by the pressure of the air blower 3*a*. Thereafter, the golf ball is seated onto a rubber tee 5 which is provided at a predetermined position on the tee-up device 4. As such, the golfer can repeatedly practice his/her golf swing.

However, in such a golf ball conveying apparatus, because most indoor driving ranges are small, the first pipe and the temporary storage container may interfere with the swing of a golfer. This makes it difficult for the golfer to concentrate on his/her swing. Furthermore, if a damaged golf ball enters the second ball conveying pipe, the damaged golf ball becomes stuck due to friction between the inner surface of the second ball conveying pipe and a damaged portion of the golf ball. Thus, the second ball conveying pipe is clogged by the damaged golf ball. In particular, because the second ball conveying pipe is embedded in the ground, it is very difficult to remove the damaged golf ball from the second ball conveying pipe.

Typically, a golfball has dimples which are intended to increase the distance that the golfball travels. However, in the conventional golf ball conveying apparatus, while a golf ball rapidly moves along the second ball conveying pipe, the dimples of the golfball wear rapidly due to contact between the golfball and the inner surface of the second ball conveying pipe. Thus, the lifetime of the golf ball is reduced.

BRIEF SUMMARY OF THE INVENTION

Accordingly, the present invention has been made keeping in mind the above problems occurring in the prior art, and an object of the present invention is to provide a golf ball conveying apparatus which is reduced in size, thus providing a golfer with plenty of room in a driving range, and which prevents dimples of a golf ball from wearing during a process of conveying the golf ball, and in which, even if a damaged golf ball enters a ball conveying pipe, the damaged golf ball is easily removed from the ball conveying pipe, thus solving a problem of the ball conveying pipe becoming clogged by a damaged golf ball.

In order to accomplish the above object, the present invention provides a golf ball conveying apparatus, including: a support bracket provided at a predetermined position in a housing of a tee-up device, with a through hole and a coupling hole formed at predetermined positions through the support bracket; a rotating pipe inserted at an end thereof into the through hole of the support bracket, with a spiral protrusion provided on an inner surface of the rotating pipe, and a gear provided at a predetermined position on an outer surface of the rotating pipe; and a pipe support unit provided around each of opposite ends of the rotating pipe. The pipe support unit has a pipe holding plate placed on a surface of the support bracket, with a bearing provided in the pipe holding plate, a plurality of spring seats provided at predetermined positions in the pipe holding plate, and a plurality of springs seated in the spring seats, respectively, so that the bearing is supported by the plurality of springs seated in the spring seats and is in close contact at an inner surface thereof with the rotating pipe. The pipe support unit further has a cover coupled to a surface of the pipe holding plate, with a coupling hole formed at a predetermined position through the cover, so that a locking bolt passes through both a coupling hole of the cover and a coupling hole of the pipe holding plate and is fastened into the coupling hole which is provided in the support bracket and has an internal thread, thus the pipe support unit supports the rotating pipe. The golf ball conveying apparatus further includes a motor provided at a predetermined position on the support bracket, with a gear provided on an output shaft of the motor and coupled to the gear of the rotating pipe by a chain, thus rotating the rotating pipe.

BRIEF DESCRIPTION OF THE SEVERAL VIEWS OF THE DRAWINGS

The above and other objects, features and advantages of the present invention will be more clearly understood from the following detailed description taken in conjunction with the accompanying drawings.

DETAILED DESCRIPTION OF THE INVENTION

Hereinafter, a preferred embodiment of the present invention will be described in detail with reference to the attached drawings.

Figure 1:
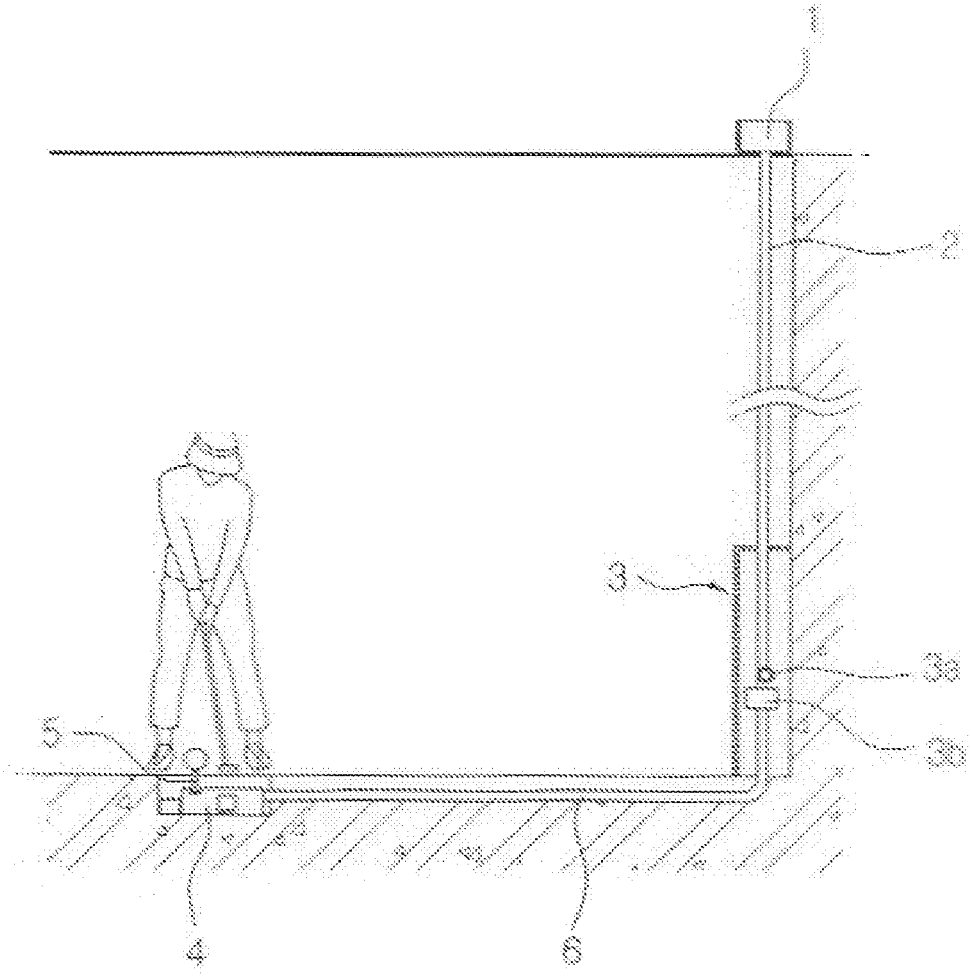
PRIOR ART fig 1
FIG. 1 is a sectional view showing an indoor driving range in which a conventional golf ball conveying apparatus is established.
Figure 2:
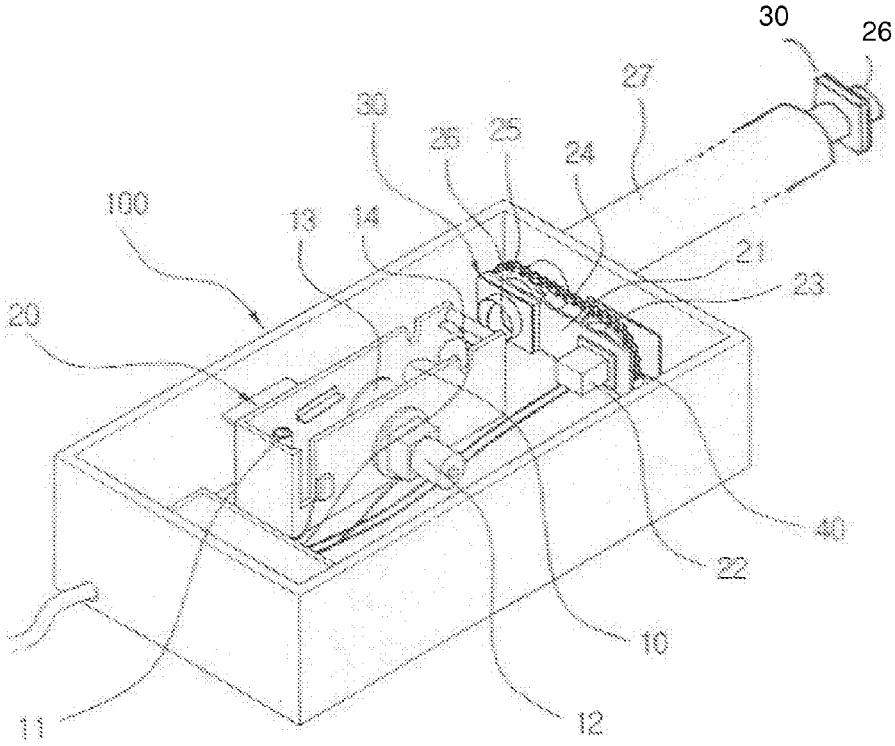
FIG. 2 is a perspective view of a golf ball conveying apparatus, according to an embodiment of the present invention.
Figure 3:
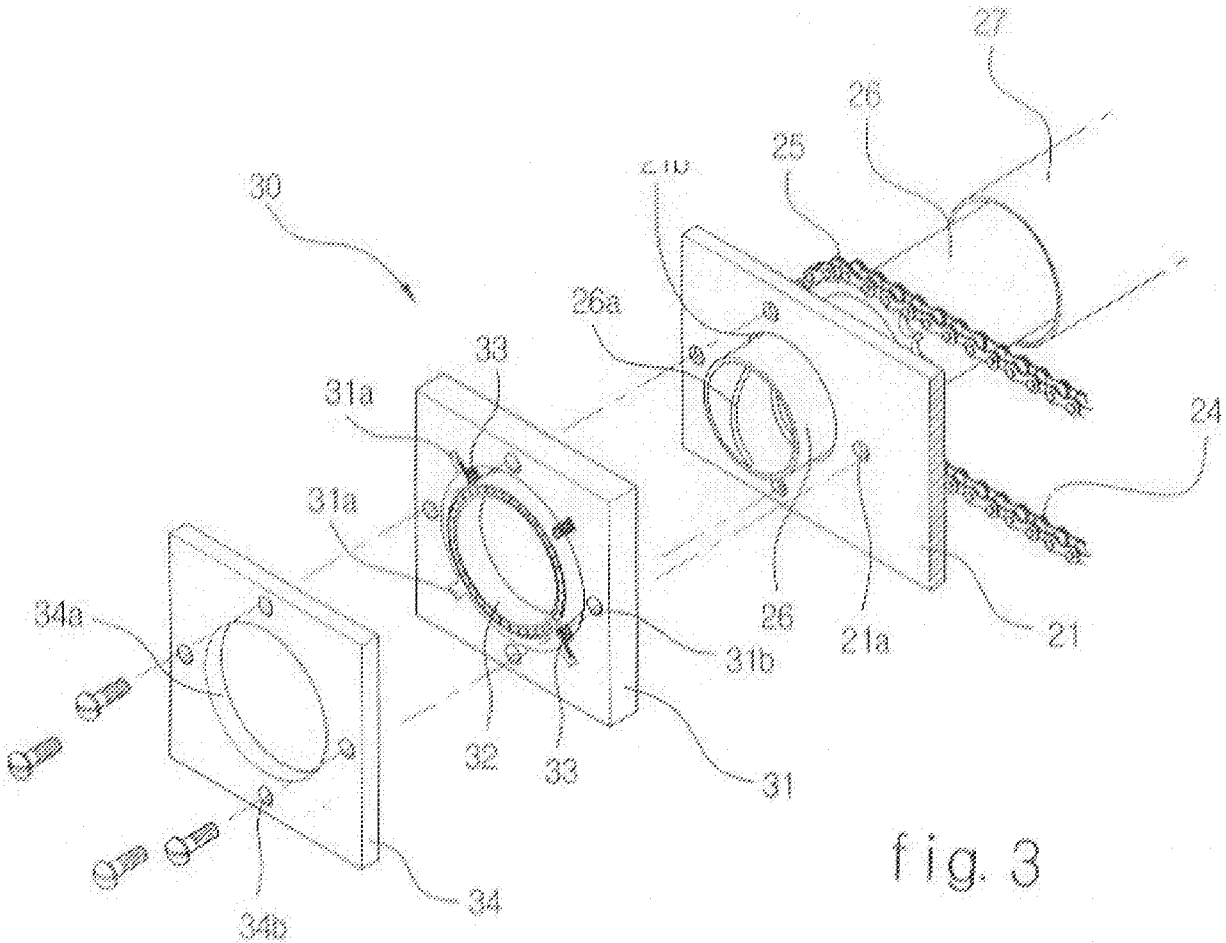
FIG. 3 is an exploded perspective view showing a pipe support unit of the golfball conveying apparatus of FIG. 2.
Figure 4:
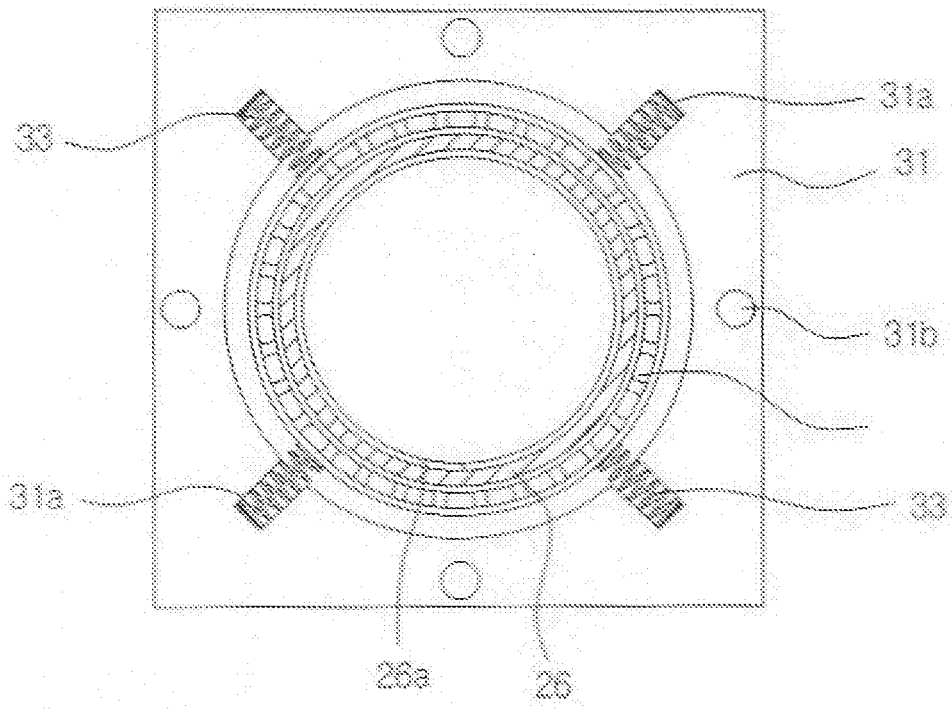
FIG. 4 is a side elevation view showing the assembled pipe support unit of FIG. 3.
Figure 5:
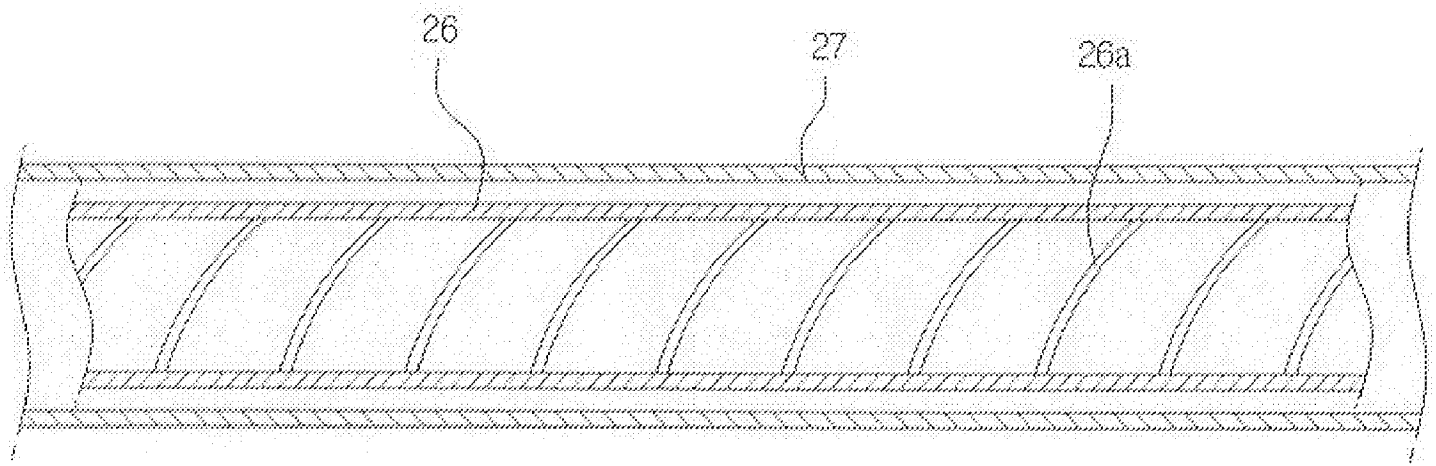
FIG. 5 is a longitudinal sectional view showing a rotating pipe of the golf ball conveying apparatus according to the present invention.

FIG. 2 is a perspective view of a golf ball conveying apparatus, according to an embodiment of the present invention. FIG. 3 is an exploded perspective view showing a pipe support unit 30 of the golfball conveying apparatus of FIG. 2. FIG. 4 is a side view showing the assembled pipe support unit 30 of FIG. 3. FIG. 5 is a longitudinal sectional view showing a rotating pipe 26 of the golf ball conveying apparatus according to the present invention.

As shown in FIG. 2, a tee-up device 100, which is embedded in the ground underneath a user, includes a golf ball setting device 20 which is provided at a predetermined position in the housing of the tee-up device 100, and a pipe driving unit 40 which is provided in the housing near the golf ball setting device 20. The golf ball setting device 20 has a sensor 14 to monitor whether a golf ball is on a tee 11 or not, and a rotating body 13 which is rotated by a first motor 12 that is provided at a predetermined position in the golf ball setting device 20, so that a golf ball 10 is seated on the tee 11 by the rotating body 13.

The pipe driving unit 40 has a support bracket 21 which is attached at a predetermined position to the housing of the tee-up device 100. Two through holes 21*b* are formed at predetermined portions through the support bracket 21. Both a second motor 22 and a first gear 23, which is coupled to the second motor 22, are supported by the support bracket 21 using one through hole 21*b*. The rotating pipe 26, which is integrally provided with a second gear 25 coupled to the first gear 23 by a chain 24, passes through the remaining through hole 21*b* of the support bracket 21. The pipe support unit 30 is placed on the surface of the support bracket 21 at a position corresponding to the rotating pipe 26.

The pipe support unit 30 is provided on the support bracket 21 at a position corresponding to the rotating pipe 26. The pipe support unit 30 includes a pipe holding plate 31 which is placed on the support bracket 21. A bearing 32 is provided in the pipe holding plate 31. A plurality of spring seats 31*a* is provided around the bearing 32 in the pipe holding plate 31. A spring 33 is seated in each spring seat 31*a*, so that the bearing 32 is supported by the springs 33 seated in the spring seats 31*a* and is in close contact at an inner surface thereof with the rotating pipe 26. The pipe support unit 30 further includes a cover 34 which is provided on the surface of the pipe holding plate 31, with a through hole 34*a* formed through the cover 34 to pass the rotating pipe 26 through the cover 34. A coupling hole 34*b* is formed at a predetermined position through the cover 34, so that a locking bolt passes through both the coupling hole 34*b* of the cover 34 and a coupling hole 31*b* of the pipe holding plate 31 and is fastened into the coupling hole 21*a* which is provided in the support bracket 21 and has an internal thread. Thus, the pipe support unit 30 supports the rotating pipe 26.

Furthermore, a spiral protrusion 26*a* is provided on an inner surface of the rotating pipe 26. The second gear 25 is integrally provided at a predetermined position on an outer surface of the rotating pipe 26. The rotating pipe 26 passes through an outer pipe 27. The outer pipe 27 corresponds to the second conveying pipe 6.

The operation of the golf ball conveying apparatus of the present invention will be explained herein below.

First, a golf ball, struck by a golfer, is conveyed to a golf ball conveyor provided on an upper portion of a driving range. Thereafter, the golf ball is supplied to a ball conveying pipe (not shown) which is installed in a support wall of the driving range.

Subsequently, the golf ball moves to the ground through the ball conveying pipe. Thereafter, the golf ball is supplied into the rotating pipe 26 which is embedded in the ground. Here, because the rotating pipe 26 is inserted into the outer pipe 27 and the opposite ends of the rotating pipe 26 are supported by the pipe support units 30, even if the rotating pipe 26 is embedded in the ground, the rotation of the rotating pipe 26 is reliable.

Furthermore, the pipe support unit 30 is placed on the surface of the support bracket 21, and the through hole 21*b*, which is greater in diameter than the outer diameter of the rotating pipe 26, is formed through the support bracket 21. Thus, the rotating pipe 26 passes through the through hole 21*b* of the support bracket 21. Moreover, the rotating pipe 26 passes through the pipe holding plate 31 such that the outer surface of the rotating pipe 26 is in close contact with the inner surface of the bearing 32 which is provided in the pipe holding plate 31 and is supported by the plurality of springs 33. The cover 34 including the through hole 34*a*, through which the rotating pipe 26 passes, and which has the same diameter as the through hole 21*b* of the support bracket 21, is coupled to the pipe holding plate 31 by the locking bolt. Thus, the elasticity of the springs 33 prevents the bearing 32 from damage due to movement of the rotating pipe 26, so that the rotating pipe 26 can smoothly rotate.

Meanwhile, the second gear 25 is integrally provided on the rotating pipe 26 at a predetermined position in the tee-up device 100. The first gear 23 of the second motor 22 is coupled to the second gear 25 by the chain 24. Therefore, when the second motor 22 is operated, the second gear 25 rotates along with the first gear 23. As a result, the rotating pipe 26 rotates.

As such, when the rotating pipe 26 rotates, a golf ball, which is in the rotating pipe 26, rotates and moves along the spiral protrusion 26*a*, which is provided on the inner surface of the rotating pipe 26, and the golf ball moves along the rotating pipe 26 to the tee-up device 100. Here, even if the rotating pipe transversely vibrates while rotating, because the bearing 32 is supported by the springs 33 of the pipe support unit 30, the bearing 32 is prevented from being damaged.

When the second motor 22 reversely rotates, the golf ball in the rotating pipe 26 is discharged to the outside through the end of the rotating pipe 26 opposite the tee-up device 100. Therefore, the present invention can easily remove a damaged golf ball from the rotating pipe 26.

Furthermore, the sensor 14 is provided in the golfball setting device 20. Accordingly, because the sensor 14 monitors whether a golf ball is on the tee 11 or not, only when no golf ball is placed on the tee 11 is the second motor 22 operated.

As described above, a golf ball conveying apparatus according to the present invention does not require a separate temporary storage container. Therefore, compared with conventional apparatuses, a golfer can use a larger space in an indoor driving range. Furthermore, the golf ball conveying apparatus of the present invention has a simple structure and the method of operating the apparatus is easy. Thus, even if the rotating pipe becomes clogged by a damaged golf ball, the present invention can easily remove the damaged golf ball. In addition, the present invention has markedly reduced manufacturing costs compared with conventional apparatuses.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

I claim:

1. A golf ball conveying apparatus, having a golf ball conveyor provided on an upper end of a support wall, a first conveying pipe coupled to the golf ball conveyor and supported on the support wall, a second conveying pipe coupled to the first conveying pipe and embedded in ground, and a tee-up device coupled to an end of the second conveying pipe, the apparatus comprising:

a support bracket provided at a predetermined position in a housing of the tee-up device, with a through hole and a coupling hole formed at predetermined positions through the support bracket;

a rotating pipe inserted at an end thereof into said through hole of said support bracket, with a spiral protrusion provided on an inner surface of the rotating pipe, and a gear provided at a predetermined position on an outer surface of said rotating pipe;

a pipe support unit provided around each of opposite ends of said rotating pipe; and a motor provided at a predetermined position on said support bracket, with a gear provided on an output shaft of said motor and coupled to the gear of the rotating pipe by a chain, thus rotating the rotating pipe.

2. The golf ball conveying apparatus as set forth in claim 1, wherein said pipe support unit comprises:

a pipe holding plate placed on a surface of said support bracket, with a bearing provided in the pipe holding plate, a plurality of spring seats provided at predetermined positions in the pipe holding plate, and a plurality of springs seated in the spring seats, respectively, the bearing being supported by the plurality of springs seated in the spring seats and being in close contact at an inner surface thereof with the rotating pipe; and a cover provided on a surface of the pipe holding plate, with a through hole formed through the cover to pass the rotating pipe through the cover, and a coupling hole formed at a predetermined position through the cover, a locking bolt passing through both the coupling hole of the cover and a coupling hole of the pipe holding plate and being fastened into the coupling hole which is provided in the support bracket and has an internal thread, said pipe support unit supporting said rotating pipe.

* * * * *